United States Patent [19]

Yamada

[11] 4,373,705

[45] Feb. 15, 1983

[54] METHOD AND APPARATUS FOR SEPARATING SLAG AND POURING MOLTEN STEEL OUT OF A CONTAINER SUCH AS A CONVERTER OR THE LIKE

[75] Inventor: Hirosuke Yamada, Kurashiki, Japan

[73] Assignee: Kawasaki Steel Corporation, Kobe, Japan

[21] Appl. No.: 221,351

[22] Filed: Dec. 29, 1980

[30] Foreign Application Priority Data

Dec. 27, 1979 [JP] Japan ..... 54-169130

[51] Int. Cl.[3] ..... F27D 3/14

[52] U.S. Cl. ..... 266/227; 266/236; 222/590

[58] Field of Search ..... 266/243, 227, 230, 232, 266/236, 238, 240, 217, 195; 75/61; 222/590, 595, 603, 604

[56] References Cited

U.S. PATENT DOCUMENTS 4,274,622 6/1981 Ohmori ..... 266/227

FOREIGN PATENT DOCUMENTS 1379236 1/1975 United Kingdom ..... 222/590

*Primary Examiner*—L. Dewayne Rutledge
*Assistant Examiner*—David A. Hey
*Attorney, Agent, or Firm*—Balogh, Osann, Kramer, Dvorak, Genova, Traub

[57] ABSTRACT

Method and apparatus for separating slag and pouring molten steel out of a container such as a converter or the like, which makes use of a gas jet member for jetting an inert gas into the flow of the molten steel in a descending portion of a U-shaped passage communicated with a molten steel outlet opening of the converter, whereby the gas jet causes the flow speed of the molten steel to retard so as to eliminate the influence of inertia force of the flow of the molten steel exerted to a balance between the static pressure of the residual molten steel and the static pressure of the residual slag in the U-shaped passage.

7 Claims, 4 Drawing Figures

METHOD AND APPARATUS FOR SEPARATING SLAG AND POURING MOLTEN STEEL OUT OF A CONTAINER SUCH AS A CONVERTER OR THE LIKE

BACKGROUND OF THE INVENTION

1. Field of the Invention

This invention relates to a method and apparatus for separating slag and pouring molten steel out of a container such as a converter or the like, which can efficiently pour the molten steel only out of the container without degrading the yield of the molten steel.

2. Description of the Prior Art

In the case of pouring molten steel out of a converter after a refining has been completed, slag is often mixed into the molten steel during its pouring and particularly at the end thereof. In general, it is difficult to eliminate such drawback. The slag mixed into the molten steel degrades the yield of alloy material and promotes the erosion of ladle refractories. In addition, there is a risk of the quality of steel being deteriorated. Moreover, the slag mixed into the molten steel causes the concentration of phosphorus in the molten steel to increase.

As a result, it is most important to prevent the slag from pouring into the ladle at the tapping. Many attempts have been made to overcome this problem, but hitherto none has led to fully satisfactory results owing to the following reasons.

A conventional method of using an open and closing device such as a sliding gate or the like provided at the tapping hole of the converter can prevent the slag from mixing into the molten steel, but has the disadvantage that the yield of the molten steel becomes degraded and that the maintenance of the open and closing device applied to a large converter is difficult.

Another conventional method of using a ladle provided therein with a slag pot and of collecting the slag therein has the disadvantage that the temperature drop of the molten steel is large. In order to obviate such disadvantage a slag stop ball has generally been used or after the molten steel has been poured the flow of molten steel is deviated from the ladle, that is use has been made of a so-called ladle cut or the like. The latter two methods are easy in operation, but lack in reliability.

In order to avoid such drawback, the following apparatus for separating slag and pouring molten steel out of a container such as a converter or the like has been proposed. This apparatus comprises a container for containing molten metal and slag covering the free surface of the molten metal, a U-shaped passage composed of a descending portion communicated with a tapping hole of the container, an intermediate portion and an ascending portion communicated with an outlet opening of the U-shaped passage and secured to and located at the lower side portion of the container when it is tilted into its molten steel pouring position after the refining has been completed, the U-shaped passage being operative to keep the static pressure of the residual molten steel in balance with the static pressure of the residual slag therein.

This apparatus is based on the following basic idea.

The condition under which the static pressure of the residual molten steel in the U-shaped passage is kept in balance with the static pressure of the residual slag flowing after the molten steel and also remaining in the U-shaped passage so as to prevent the slag from flowing out of the U-shaped passage is given by the following formula (1).

$$h_2\rho_m > (h_1 + h_s)\rho_s \quad (1)$$

where $\rho_m$ is a molten steel density, $\rho_s$ is a slag density, $h_1$ is a height of the descending portion of the U-shaped passage, $h_2$ is a height of the ascending portion of the U-shaped passage and $h_s$ is a thickness of the slag remained in the converter.

As a result, if the U-shaped passage is constructed such that $h_1$ and $h_2$ satisfy the formula (1), it is possible to prevent the slag from flowing out of the U-shaped passage.

But, the above mentioned formula (1) is a conditional equation by taking into consideration only the static balance of the molten steel with the slag.

SUMMARY OF THE INVENTION

An object of the invention is to provide a method of separating slag and pouring molten steel out of a container such as a converter or the like, which can reduce the flow speed of the molten steel at the end of the flow thereof and which can define a condition under which the slag is reliably separated from the molten steel, whereby the slag is completely prevented from flowing out the molten metal passage at the end of the flow of molten steel.

Another object of the invention is to provide an apparatus for separating slag and pouring molten steel out of a container such as a converter or the like, which is simple in construction and which can frequently be used for a number of times at a high temperature without inducing any trouble.

A feature of the invention is the provision of a method of separating slag and pouring molten steel out of a container such as a converter or the like, the method including guiding the molten steel into a U-shaped passage composed of a descending portion communicated with a tapping hole of the container, an intermediate portion and an ascending portion communicated with an outlet opening of the U-shaped passage and secured to and located at the lower side portion of the container when it is tilted into its molten steel pouring position after the refining has been completed, the U-shaped passage being operative to keep the static pressure of the residual molten steel in balance with the static pressure of the residual slag therein, characterized by jetting an inert gas which does not positively react with the molten steel directly into the flow of the molten steel in said descending portion of the U-shaped passage, whereby the gas jet causes the flow speed of the molten steel to retard so as to eliminate the influence of inertia force of the flow of the molten steel exerted to said balance between the static pressure of the residual molten steel and that of the residual slag in said U-shaped passage, and effect a complete separation of the slag and molten steel.

Another feature of the invention is the provision of an apparatus for separating slag and pouring molten steel out of a container such as a converter or the like, including a container for containing molten metal and slag covering the free surface of the molten metal, a U-shaped passage composed of a descending portion communicated with a tapping hole of said container, an intermediate portion and an ascending portion communicated with an outlet opening of said U-shaped passage and secured to and located at the lower side portion of said container when it is tilted into tapping position after the refining has been completed, the U-shaped passage being operative to keep the static pressure of the residual molten steel in balance with the static pressure of the residual slag therein, characterized by including a gas jet member which transverses the wall of said U-shaped passage member and communicates with the descending portion of the U-shaped passage and operative to jet an inert gas which does not positively react with the molten steel into the flow of the molten steel in said descending portion of the U-shaped passage, whereby the gas jet causes the flow speed of the molten steel to retard so as to eliminate the influence of inertia force of the flow of the molten steel exerted to said balance between the static pressure of the residual molten steel and the static pressure of the residual slag in the U-shaped passage.

Further objects and features of the invention will be fully understood from the following detailed description with reference to the accompanying drawings, wherein:

DETAILED DESCRIPTION OF THE PREFERRED EMBODIMENTS

The inventor has found out that the molten steel flows with an inertia force. If this inertia force of the flow of the molten steel is taken into consideration, the condition under which the slag is completely separated from the molten steel is given by the following formula (2).

$$h_2\rho_m > (h_1 + h_s)\rho_s + \alpha \quad (2)$$

where $\alpha$ is an inertial force of the flow of molten steel.

As a result, in order to completely separate the slag and pour the molten steel out of the converter, it is necessary to remove any influence of the inertia force $\alpha$ (1) by making $h_2$ long relative to $h_1$ or (2) by decreasing the flow speed of the molten steel at the end of its pouring.

In practice, however, the use of measures of making the height $h_2$ large is limited by physical restrictions such as the restrictions of the furnace body, its tilting angle or the like.

As a result, it is important to make the flow speed of molten steel small. In order to attain such object, an attempt has been made to reduce the diameter of the inlet side of the molten steel passage and enlarge the diameter of the intermediate portion of the molten steel passage, thereby decreasing the flow speed of the molten speed. In this case, the diameter of the molten steel passage becomes changed due to the damage of the fire brick so that it is very difficult to maintain a given diameter of the molten steel passage. As a result, the flow speed of the molten steel could not be made small when the molten steel passage has been frequently used for a number of times.

In order to eliminate such drawback, the inventor has tried to jet an inert gas into the flow of the molten steel in a manner which will be described with reference to FIGS. 2A, 2B and 3.

Figure 1:
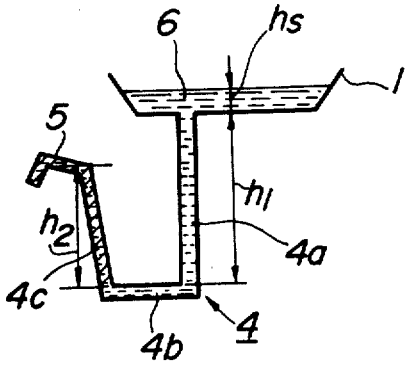
FIG. 1 is a diagrammatic cross-sectional view of essential parts of an apparatus according to the invention.

FIG. 1 shows a U-shaped passage secured to a converter. In FIG. 1, reference numeral 1 designates a converter, and 4 a U-shaped passage. The U-shaped passage 4 is composed of a descending portion 4a communicated with a molten steel tapping hole 2 (FIG. 2A) of the converter 1, an intermediate portion 4b and an ascending portion 4c communicated with an outlet opening of the U-shaped passage 4. Reference numeral 5 shows the residual molten steel and 6 the residual slag.

As described above, the condition under which the static pressure of the residual molten steel 5 in the U-shaped passage 4 is kept in balance with the static pressure of the residual slag 6 flowing after the molten steel 5 and also remaining in the U-shaped passage 4 so as to prevent the slag 6 from flowing out of the U-shaped passage 4 is given by the following formula (1).

$$h_2\rho_m > (h_1 + h_s)\rho_s \quad (1)$$

where $\rho_m$ is a molten steel density, $\rho_s$ is a slag density, $h_1$ is a height of the descending portion 4a of the U-shaped passage 4, $h_2$ is a height of the ascending portion 4c of the U-shaped passage 4, and $h_s$ is a thickness of the slag 6 remained in the converter 1.

If the inertia force of the flow of molten steel is taken into consideration, the formula (1) is changed into the formula (2) which is given by $$h_2\rho_m > (h_1 + h_s)\rho_s + \alpha \quad (2)$$

where $\alpha$ is an inertia force of the flow of molten steel.

Figure 2A:
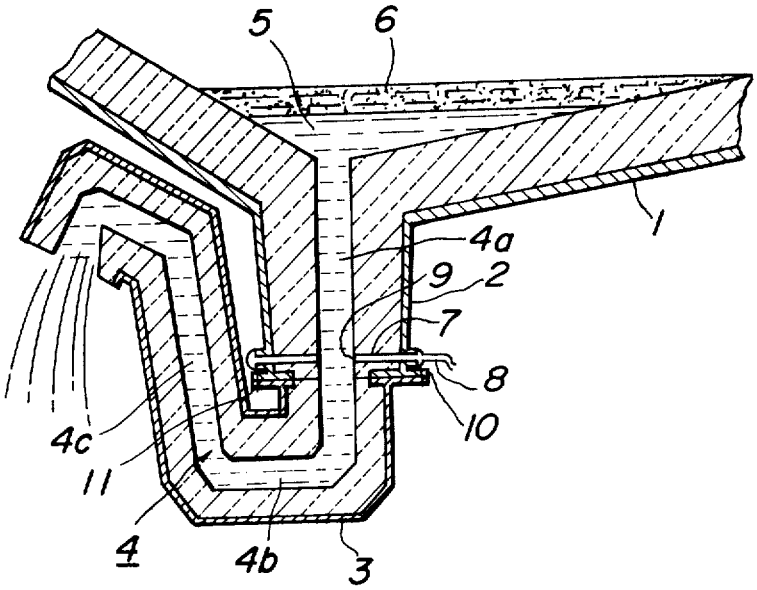
FIG. 2A is a partial longitudinal sectional view of essential parts of one embodiment of an apparatus for separating slag and pouring molten steel out of a container such as a converter or the like according to the invention.

Referring to FIG. 2A, reference numeral 1 designates a furnace body of a converter, 2 its tapping hole and 3 a molten steel pouring device detachably secured to the tapping hole 2 by means of a connection flange 11 and consisting of a U-shaped passage 4 composed of a descending portion 4a, an intermediate portion 4b and an ascending portion 4c. Reference numeral 5 designates molten steel and 6 slag floating on the free surface of the molten steel 5.

When the converter is tilted to a position shown in FIG. 2A where the molten steel 5 is poured out of the converter, the molten steel 5 in the furnace is guided through the U-shaped passage 4 to a ladle (not shown).

In the present invention, the tapping hole 2, that is, the descending portion 4a of the U-shaped passage 4 is provided at its lower portion with a gas jet member 7, in the present embodiment, a gas jet pipe. At least at the end of the molten steel pouring period, an inert gas such as $N_2$ gas or the like is jetted from the gas jet pipe 7 directly into the flow of molten steel in the descending portion 4a of the U-shaped passage 4 to decrease the flow speed of the flow of the molten steel due to the influence exerted by buoyancy of gas bubbles and due to the effect of these gas bubbles of reducing the sectional area of the U-shaped passage 4.

Figure 3:
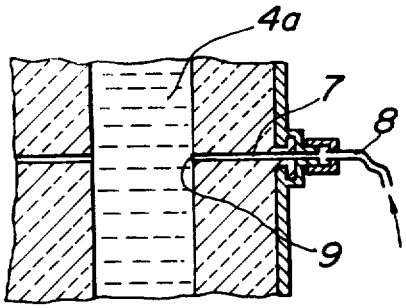
FIG. 3 is an enlarged cross-sectional view of a gas jet member shown in FIGS. 2A and 2B.

As shown in FIG. 3, in the case of jetting the gas, a pipe 7 having a diameter of at most 6 mm, preferably 2 to 3 mm is extended through or transverses a refractory wall and communicates with the descending portion 4a of the U-shaped passage 4. To that end of the pipe 7 which is located at the furnace body side is connected a hose 8 which is connected to a jet gas source (not shown). The use of the pipe 7 whose diameter is at most 6 mm ensures a natural solidification of molten steel which has eventually penetrated into the pipe 7, thereby averting danger. It is preferable to determine the diameter of the pipe 2 to 3 mm since the amount of flow of gas required for preventing the pipe 7 from clogging is desirous to be small. If the diameter of the pipe 7 is smaller than 2 mm, the pipe 7 becomes clogged with foreign material or the like, thereby involving trouble in maintenance.

In this way, it is possible to substantially eliminate the influence of the inertia force $\alpha$ given by the formula (2) by means of the gas jet. As a result, if the condition given by the formula (1), that is, the condition derived from the static pressure balance between the molten steel and the slag is satisfied, the molten steel can be poured out of the converter by completely separating the slag therefrom. In addition, it is not necessary to make the molten steel pouring device large in size.

In practice, during the period from the beginning of pouring the molten steel out of the converter to the end thereof, a gas pressure on the order such that the molten steel does not penetrate into the jet pipe 7 is applied thereto. Only at the end of pouring the molten steel out of the converter, the amount of gas which is required for sufficiently reducing the flow speed of the flow of the molten steel is jetted out of the jet pipe 7.

If the amount of the jet flow is excessively large, the jet flow causes the molten steel and slag to agitate, thereby mixing the slag into the molten steel. As a result, the amount of jet gas is made less than 5 $Nm^3$/min. For example, in the case of a converter having a capacity of 200 ton, it is preferable to determine the amount of jet gas on the order of 0.2 to 2 $Nm^3$/min. The use of small amount of gas on the order of 0.2 $Nm^3$/min ensures a retardation effect, but the amount of jet gas which is smaller than 0.2 $Nm^3$/min is not sufficient to retard the flow speed of the molten steel.

The gas jet pipe 7 may be communicated with any position along the descending portion 4a of the U-shaped passage 4. But, the inertia force can more efficiently be removed if the gas jet pipe 7 is communicated with the lower position 9 of the descending portion 4a of the U-shaped passage 4 as shown in FIGS. 2A and 3.

Figure 2B:
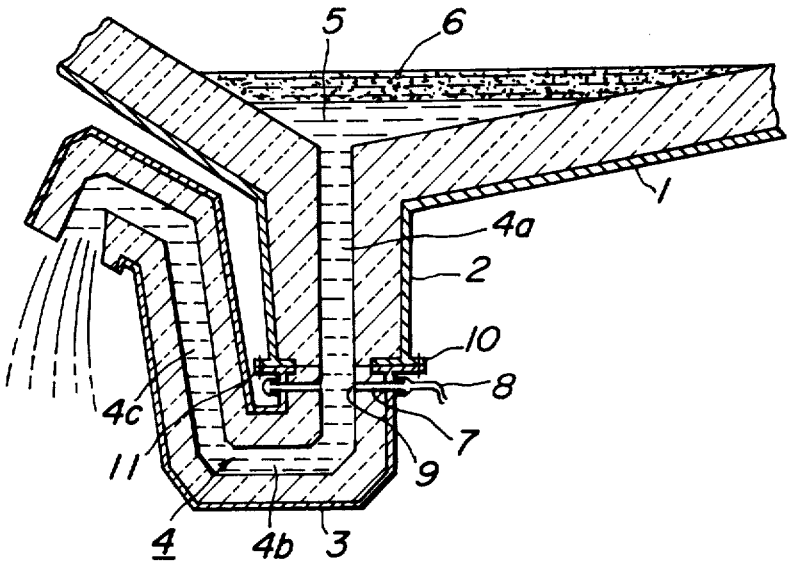
FIG. 2B is a partial longitudinal sectional view of essential parts of another embodiment of an apparatus for separating slag and pouring molten steel out of a container such as a converter or the like according to the invention.

FIG. 2B shows another embodiment of an apparatus according to the invention. In the present embodiment, the gas jet pipe 7 is communicated with that position 10 of the descending portion 4a of the U-shaped passage 4 which is located below the connection flange 11. In the present embodiment, since the gas jet pipe 7 is secured to the U-shaped passage 4 detachably mounted on the converter, the gas jet pipe 7 together with the U-shaped passage 4 may be easily removed from the converter 1 and the gas jet pipe 7 may be repaired or replaced by new one.

If the gas jet pipe 7 is continuously operated to jet the inert gas into the U-shaped passage 4 during the molten steel pouring operation, it is possible to adjust the molten steel pouring speed, that is, the amount of flow of the molten steel as required. As a result, this adjustment may be applied to the control of adapting the condition under which alloy compositions are added to the molten steel poured out of the U-shaped passage.

As stated hereinbefore, the invention is capable of efficiently pour the molten steel only out of the converter without degrading the yield of the molten steel and without making the molten steel pouring apparatus large in size.

What is claimed is:

1. In a method of separating slag and pouring molten steel out of a container such as a converter or the like, comprising guiding the molten steel into a U-shaped passage composed of a descending portion communicated with a molten steel outlet opening of the container, an intermediate portion and an ascending portion communicated with an outlet opening of the U-shaped passage and secured to and located at the lower side position of the container when it is tilted into its tapping position after the refining has been completed, the U-shaped passage being operative to keep the static pressure of the residual molten steel in balance with the static pressure of the residual slag, the improvement which comprises jetting an inert gas which does not positively react with the molten steel directly into the flow of the molten steel in said descending portion of the U-shaped passage, the amount of flow of the jet gas being at most 5 $Nm^3$/min, whereby the jet gas causes the flow speed of the molten steel to retard so as to eliminate the influence of the inertia force of the flow of the molten steel exerted to said balance between the static pressure of the residual molten steel and the static pressure of the residual slag in said U-shaped passage and effect a complete separation of the slag and molten steel.

2. The method according to claim 1, wherein the amount of flow of said jet gas is 0.2 to 2 $Nm^3$/min.

3. In an apparatus for separating slag and pouring molten steel out of a container such as a converter or the like, comprising a container for containing molten metal and slag convering the free surface of the molten metal, a U-shaped passage member composed of a descending portion communicated with a molten steel outlet portion of said container, an intermediate portion and an ascending portion communicated with an outlet opening of said U-shaped passage member and secured to and located at the lower side portion of said container when it is tilted into its molten steel pouring position after the refining has been completed, said U-shaped passage member being operative to keep the static pressure of the residual molten steel in balance with the static pressure of the residual slag therein, the improvement comprising a gas jet member which transverses the wall of said U-shaped passage member and communicates with the descending portion of said U-shaped passage member and operative to jet an inert gas which does not positively react with the molten steel into the flow of the molten steel in the descending portion of the U-shaped passage member, whereby the gas jet causes the flow speed of the molten steel to retard so as to eliminate the influence of inertia force of the flow of the molten steel exerted to said balance between the static pressure of the residual molten steel and the static pressure of the residual slag in said U-shaped passage member.

4. The apparatus according to claim 3, wherein said gas jet member is communicated with the lower side portion of that descending portion of said U-shaped passage member which is made integral with the molten steel outlet opening of said container.

5. The apparatus according to claim 3, wherein said gas jet member is communicated with the upper side portion of that descending portion of said U-shaped passage member which is detachably connected to the molten metal outlet opening of said container.

6. The apparatus according to claim 3, wherein said gas jet member is composed of a metal pipe having a diameter of at most 6 mm.

7. The apparatus according to claim 3, wherein said gas jet member is composed of a metal pipe having a diameter of 2 to 3 mm.

* * * * *